US007082649B2

(12) United States Patent
Aoki et al.

(10) Patent No.: US 7,082,649 B2
(45) Date of Patent: Aug. 1, 2006

(54) METAL WIRE ROD FOR FORMING SLIDE FASTENER COUPLING ELEMENTS AND SLIDE FASTENER COUPLING ELEMENT FORMED FROM THE SAME METAL WIRE ROD

(75) Inventors: Toshio Aoki, Toyama-ken (JP); Kunio Miyazaki, Toyama-ken (JP); Manami Oono, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/397,225

(22) Filed: Mar. 27, 2003

(65) Prior Publication Data

US 2003/0192150 A1 Oct. 16, 2003

(30) Foreign Application Priority Data

Apr. 11, 2002 (JP) ..... 2002-108780

(51) Int. Cl.
*A44B 19/06* (2006.01)

(52) U.S. Cl. ..... 24/414

(58) Field of Classification Search ..... 24/409–411, 24/413, 414, 403, 412, 406–408; 29/410; 428/582, 583

See application file for complete search history.

(56) References Cited

U.S. PATENT DOCUMENTS

| | | | | | |
|---|---|---|---|---|---|
| 1,609,080 | A | * | 11/1926 | Freysinger | 24/406 |
| 1,701,555 | A | * | 2/1929 | Binns | 24/405 |
| 1,741,789 | A | * | 12/1929 | Peiffer et al. | 24/406 |
| RE17,865 | E | * | 11/1930 | Winterhalter | 24/411 |
| 2,116,712 | A | * | 5/1938 | Prentice | 29/410 |
| 2,116,726 | A | * | 5/1938 | Legat | 29/410 |
| 2,335,668 | A | | 11/1943 | Hamm | |
| 2,489,718 | A | * | 11/1949 | Morin | 29/410 |
| 2,596,888 | A | * | 5/1952 | Cohn | 29/410 |
| 2,885,775 | A | * | 5/1959 | Morin | 29/410 |
| 3,068,908 | A | * | 12/1962 | Firing | 139/384 B |
| 3,091,024 | A | * | 5/1963 | Poux | 29/410 |
| 4,004,327 | A | | 1/1977 | Fukuroi et al. | |
| 4,388,751 | A | * | 6/1983 | Fukuroi | 29/410 |
| 5,367,758 | A | | 11/1994 | Morioka et al. | |
| 6,423,423 | B1 | | 7/2002 | Akutsu et al. | |

FOREIGN PATENT DOCUMENTS

| | | |
|---|---|---|
| DE | 459959 | 5/1928 |
| EP | 6 608 770 | 8/1994 |
| GB | 571113 | 8/1945 |
| GB | 710402 | 6/1954 |
| JP | 51-13903 | 1/1976 |
| JP | 06-217810 | 8/1994 |
| JP | 08-056714 | 3/1996 |
| KR | 20-229751 | 7/2001 |

* cited by examiner

*Primary Examiner*—James R. Brittain
(74) *Attorney, Agent, or Firm*—Finnegan, Henderson, Farabow, Garrett & Dunner, L.L.P.

(57) ABSTRACT

In a Y bar for forming coupling elements, an opening angle of a pair of right and left leg parts is narrower than that of the ordinary ones. Plural bent portions, which are bent inward, are formed successively in an extending direction of the leg parts in a range from a crotch part toward pawl parts at front ends of the leg parts. The gap between the pawl parts are narrowed gradually from proximal ends to front ends thereof. Bulging portions are provided on outer side surfaces of the crotch part. Thus, the stabilization of the posture of a metallic coupling element, which is obtained by cutting the Y bar, at the time of mounting, strength of the coupling element and stabilization of the mounting posture of the coupling element to the fastener tape can be improved.

6 Claims, 4 Drawing Sheets

METAL WIRE ROD FOR FORMING SLIDE FASTENER COUPLING ELEMENTS AND SLIDE FASTENER COUPLING ELEMENT FORMED FROM THE SAME METAL WIRE ROD

BACKGROUND OF THE INVENTION

1. Field of the Invention

The present invention relates to a metal wire rod for forming coupling elements, which is usually called a Y bar and is applied to a slide fastener, and a metallic coupling element obtained by slicing the same wire rod.

2. Prior Art

In recent years, the slide fastener market has been well on the way to globalization, so that customers tend to purchase products manufactured in a region where the production cost is low. Under this tendency, a struggle for reducing the price of product has been accelerated. Consequently, further quality improvement has been demanded so as to appeal its product value to customers. In order to manufacture the slide fastener at a lower cost and with a higher quality than conventional products, it is necessary to review the rightness of individual components constituting a slide fastener. Particularly, with respect to metallic coupling elements having a slide fastener opening/closing function, the reduction of labor cost and material cost as well as the improvement of mounting strength have been demanded strongly.

Conventionally, three major methods have been adopted for manufacturing this kind of metallic coupling element, which are a press method in which a flat wire rod is produced by pressing, a molding method by die-casting and a Y-bar method in which a metal wire rod having a substantially Y-shaped section is cut to predetermined thickness. According to this Y-bar method, a cut coupling element is composed of a head and a pair of legs extended from the head through a crotch and has a coupling protrusion formed by pressing the head with a punch.

In order to form a metal wire rod having a Y-shaped section for forming the coupling elements, which is used in the Y-bar method, is formed, usually the metal wire rod having a circular section is rolled so as to deform its section into a Y-shape. As compared with metallic coupling elements manufactured by pressing a flat plate, this method ensures a higher strength and wastes no material. Further, because it is suitable for mass production, manufacturing of metallic coupling elements based on the Y-bar method is the most reasonable manufacturing method.

In manufacturing of metallic coupling elements based on the aforementioned Y-bar method, the metal wire rod for forming coupling elements, which has a circular section, is supplied intermittently at a predetermined pitch and is subjected to multi-stage rolling processing so as to produce a substantially Y-shaped section. Particularly an external shape of pairs of right and left leg parts is formed to be opened. The coupling element just after cutting has pawls which are projected inward from a front end of each of the legs.

A wire rod having an irregular shape thus obtained is fed at a pitch corresponding to the thickness of each coupling element. When 1-pitch feeding is completed, the feeding is stopped, so that the wire rod is projected on a cutting die by the thickness of the coupling element at its front end stop position. Here, the projected portion of the wire rod is cut off with a cutting punch and at the same time, the cut coupling element material is carried from the cutting die to a forming die. A forming punch acts on a head of the coupling element material mounted on the forming die thereby forming a coupling protrusion on the head, which is so-called hill-forming.

On the other hand, on the side of the legs of the coupling element material subjected to the hill-forming as described above, a fastener tape is fed, with a predetermined gap relative to the coupling element material, at each coupling element mounting pitch such that an edge portion of the fastener tape for mounting the coupling elements oppose the crotch between the both legs. After the hill-forming is completed, the coupling element is carried toward the coupling-element-mounting edge portion of the fastener tape, so that the coupling element-mounting edge portion is nipped by the pair of legs opened outward. Here, a caulking punch is actuated so as to caulk the pair of legs inward. Thus, implantation of the coupling element to the fastener tape is completed.

Coupling element materials obtained by cutting the aforementioned metal wire rod having a Y-shaped section for forming coupling elements have been disclosed in, for example, Japanese Utility Model Application Laid-Open No. 51-13903, Japanese Patent Application Laid-Open Nos. 6-217810 and 8-56714, and Korean Patent Laid-Open Publication No. 20-229751. According to these publications, an inner face of the crotch of the coupling element is formed in a circular or a flat plane, and an inner face of each of right and left legs opened symmetrically subsequent to the crotch is formed in a mere curved face or a flat plane. This is because it is intended that the entire legs should be bent uniformly when the legs are caulked.

As indicated in the aforementioned Japanese Patent Application Laid-Open No. 8-56714 and Korean Patent Laid-Open Publication No. 20-229751, the opening angle of the right and left legs are necessarily extremely large. This is because the mounting strength of the coupling element to the fastener tape depends on biting strength of the pawls projected inward from front ends of the right and left legs, and the biting strength is mainly based on the projection length of the pawls and the intersection angle of the pawls relative to the extending direction of the legs. Therefore, the opening angle between the right and left legs needs to be extremely large.

Usually, rolling process to be applied to the metal wire rod in multiple stages is carried out by plural rolling rollers disposed so as to surround a wire rod. After this rolling process is completed, the respective rolling rollers move in a direction away from the center of the wire rod. If the pawls are projected beyond an end face of the rolling roller, the end face of the rolling roller interferes with the pawls when the rolling roller leaves, thereby disabling the rolling roller from leaving. To avoid such interference, the inner faces of the pawls need to be so designed as to be parallel to the end face of the rolling roll. As a result, the right and left legs are necessarily opened to a large extent. Additionally, the opening angle of the conventional legs is about 92°.

Further, in terms of strength of the conventional coupling element material, the strength of all portions including its head and legs is substantially equal because the metal wire rod is formed by changing its external shape and sectional shape through multi-stage rolling process.

When the inner faces of the crotch and the legs of the metallic coupling element are mere flat planes or curved faces as described above, uniform positioning accuracy can not be obtained when the same metal wire rod is deformed by rolling. Therefore, it is difficult to process the entire shape of the coupling element symmetrically with respect to a center line connecting a center of the head with a middle point of a straight line connecting front ends of the pair of legs. Further, when the coupling element having such a configuration is mounted on a fastener tape by caulking the legs thereof from outside with a caulking punch, the legs cannot be bent equally from the crotch thereof. Additionally, the coupling element is likely to rotate with respect to the head, so that the coupling element often cannot be mounted accurately on a symmetrical position nipping a coupling-element-mounting portion of the fastener tape.

Particularly, if the opening angle of the right and left legs extending from the crotch is as large as that of the conventional metallic coupling element, the mounting posture of the coupling element on a fastener tape is unstable, so that the coupling element becomes likely to rotate around the head thereof. This causes a fall of productivity in terms of yield rate. Therefore, it is preferable that the opening angle is as small as possible.

On the other hand, from a viewpoint of the mounting strength of the coupling element to the fastener tape, the head of the coupling element is not directly related to the mounting strength, while the right and left legs concern directly the mounting strength and the mounting strength depends on the configuration and strength of the legs. Therefore, it is the head of the coupling element from which the amount of material can be reduced. However, if part of the head of the coupling element is reduced, when it is mounted on the fastener tape by caulking the legs, the strength of the crotch between the head and the legs drops largely because the width dimension of the crotch is reduced due to deformation of the legs.

The present invention has been accomplished to solve the above-described problems. An object of the invention is to provide a metal wire rod, which enables reduction of the material, securing a necessary mounting strength to a fastener tape and strength of an entire coupling element, as well as manufacturing of a coupling element having such configuration and mounting strength as to stabilize a mounting posture of the coupling element to the fastener tape. A further object of the invention is to provide a coupling element obtained from the same wire rod.

SUMMARY OF THE INVENTION

The inventors considered that reduction of the amount of material of a coupling element material per unit lead to reduction of the material cost directly, which leads to, however, reduction of the mounting strength of the coupling element. Further, the mounting strength depends upon stability of the mounting posture of the coupling element to the fastener tape and the magnitude of pressing force of inner faces of the legs with respect to a core string portion extending along a coupling-element mounting portion of the fastener tape. In order to reduce the coupling element material as well as to secure the mounting strength, it is indispensable to review the sectional shape and material of a metal wire rod for forming coupling elements.

The present invention has been made by aiming at the shape of the leg parts of a metal wire rod for forming coupling elements. According to a first aspect of the present invention, there is provided a metal wire rod for forming coupling elements of a slide fastener, which has a head part and a pair of leg parts extending from the head part through a crotch part and which has a substantially Y-shaped section, characterized in that plural bent portions, which are bent inward, are formed successively in an extending direction of the leg parts on an inner face extending from the crotch part to a pawl part at a front end of each of the leg parts.

According to this aspect of the present invention, plural stages of bent portions are formed successively, by rolling, in the extending direction of the leg parts on the inner face extending from the crotch part of the metal wire rod toward the pawl part at the front end of the leg part. Consequently, the plural stages of bent portions are provided with a function for positioning with respect to the wire rod at the time of rolling processing. Thus, the sectional shape of the wire rod can be always symmetrical with respect to a plane obtained by connecting a middle point of a straight line connecting the front ends of the right and left leg parts of the wire rod with a center of the head.

Further, another aspect of the present invention is achieved by paying attention to the pawl parts projected inward from front end portions of the leg parts of the wire rod. More specifically, according to this second aspect of the present invention, there is provided a metal wire rod for forming coupling elements, which has a head part, a pair of leg parts extending from the head part through a crotch part, and pawl parts projected inward from front ends of the leg parts, and which has a substantially Y-shaped section, characterized in that a gap between inner faces of the pawl parts narrows gradually from proximal end portions of the pawl parts toward front end portions thereof.

The inner faces of the right and left pawl parts projected from front end portions of the leg parts of a conventional metal wire rod such that they intersect the same leg parts are designed to be parallel to each other because of the convenience of rolling processing. Therefore, when the coupling element obtained by cutting the coupling-element-forming metal wire rod having such a configuration of the pawl part is mounted on a fastener tape by caulking the legs, its mounting strength becomes insufficient unless the caulking angle is set large. However, if this caulking angle is set large, necessarily the caulking amount of the right and left legs increases so that an unnecessary load is applied to the fastener tape, thereby producing a fear that the tape may be broken. On the contrary, according to the present invention, a gap between the inner faces of the right and left pawl parts is narrowed gradually toward the front ends thereof. Therefore, even when the legs are caulked at a smaller crimping angle than conventionally or at an equal caulking angle, the pawls bite into the fastener tape more or in the same way as conventionally. Consequently, a higher mounting strength than required for the coupling element can be obtained without damaging the tape.

It is preferable that the pawl parts are projected inward from the front ends of the right and left leg parts and that a bent portion located between an inner face of the leg part and an inner face at the proximal end portion of the pawl part exists outside a straight line which is parallel to a straight line (center line) connecting a middle point on a straight line connecting the front ends of the right and left pawl parts with a center of the head part and which passes through the front end of the pawl part.

Specifically, the pawl part is projected from each of the leg parts such that the bent portion between the inner face of the leg part and the inner face of the proximal end portion of the pawl part is located outside a plane which is parallel to a plane connecting the middle point on the straight line connecting the front ends of the right and left pawl parts with the center of the head part and which passes through the front end of the pawl part. As a result, when the coupling element obtained by cutting the metal wire rod is mounted onto a fastener tape by caulking, the pawls of the coupling element bite into a fastener tape at a sharp angle to the coupling element head. Consequently, even when a lateral pulling force is applied to the slide fastener, the coupling element does not slip out of the tape so that a stabilized mounting state of the coupling element can be maintained.

Further, it is preferable that an opening angle between the pair of leg parts on the right and left sides is 75° to 85°. The opening angle between the conventional leg parts was about 92° as described above. The reason why such an opening angle was required is that the inner faces of the right and left pawls need to be set parallel to each other and that a predetermined biting angle with respect to a fastener tape at the time of caulking needs to be secured. Therefore, the opening angle of the leg parts was necessarily large.

According to the present invention on the other hand, because the inner faces of the right and left pawl parts are closer toward front ends thereof, even when the opening angle of the leg parts is decreased by that closer amount, the aforementioned biting angle required for the coupling element is easy to obtain. If this opening of the leg parts can be reduced, the coupling element becomes unlikely to rotate on the fastener tape even at the time of caulking. Consequently, its mounting posture is stabilized so that it can be mounted on the fastener tape with a good balance.

Furthermore, it is preferable that an outer side face of a joint portion of the head part and the leg part has a bulging portion which bulges outward from the outer side face. In a case where an outer surface of the joint portion between the head part and the leg part is formed to be flat as in an ordinary wire rod, since the outer surface of the leg part is stretched when the leg part is caulked, the outer surface of the joint portion is dented inward so that the joint portion is thinned. Thus, the strength of the joint portion becomes smaller, so that the mounting strength to the fastener tape does not reach a predetermined strength but drops.

According to the present invention on the contrary, because the bulging portion or a thicker portion is formed on the outer surface of the joint portion between the head part and the leg part of the wire rod, even when the thicker portion at the joint portion is stretched when the leg of the coupling element, which is to be obtained later, is caulked and reduced in its volume, the reduced portion is supplemented by the thicker portion, thereby preventing the joint portion from being narrowed. Consequently, the strength at the joint portion is prevented from dropping, so that the mounting strength to the fastener tape is not decreased.

Still further, it is preferable that hardness of at least a coupling protrusion forming region of the head part is smaller than that of the leg part. If the hardness of the head part is smaller than that of the leg part or it is formed softer, the coupling protrusion of the coupling element head, which is to be obtained later, is easier to form with a required height. Consequently, because the protrusion is provided with a required height, the engagement strength between the coupling elements can be improved. Further, load applied on a forming punch and a forming die used for forming the coupling protrusion is reduced, thereby making it possible to prolong the durability of the protrusion forming punch and die.

According to another aspect of the present invention, there is provided a slide fastener coupling element which has a head having a coupling protrusion and a pair of legs extending from the head through a crotch and a pawl projected inward from each of the legs, the slide fastener coupling element being mounted with the crotch and the legs nipping a side edge portion of a fastener tape, characterized in that an inner face of the coupling element is formed with plural stages of bent portions, which are provided in a range from the crotch to front ends of the legs having pawls at front end portions thereof such that they are bent inward.

Thus, the coupling element obtained by cutting the above-mentioned wire rod also becomes accurately symmetrical with respect to its center line, so that when it is mounted on a fastener tape, its mounting posture does not become unstable unlike a conventional coupling element whose inner faces form circular or are flat planes, but the coupling elements can be always mounted on a fastener tape in the same postures. Thus, the slider can be slid smoothly and rupture in the coupling elements never occurs when the slide fastener is closed.

Further, when the coupling element is mounted on a fastener tape by caulking with a caulking hammer, it can be bent accurately at the bent joint portion between the crotch and the leg and each bent portion of the leg. Consequently, not only the pawls bite into the fastener tape but also nipping planes between the respective bent portions nip an entire periphery of a core string portion of the fastener tape strongly by. As a result, the mounting strength to the fastener tape is increased, and additionally friction resistance between the polygonal inner face and the core portion is increased, thereby preventing the coupling element from being deflected along the core portion. Thus, a stabilized mounting state of the coupling element can be maintained.

It is preferable that a width dimension of the head is set smaller than a width dimension between outer side faces of the pair of legs. The stabilized mounting of the coupling element, its mounting strength and engagement strength between the coupling elements can be secured by improving the crotch, leg and pawl as described above. Thus, according to the present invention, the coupling head which is less related to those functions is paid more attention to. Even when the width of the head is set smaller than that of the pair of legs, it does not affect the aforementioned functions but leads to reduction of material at the same time. This makes it possible to reduce the manufacturing cost of the coupling element.

It is preferable that the inner face of the coupling element has plural nipping planes which are adjacent to each other via said bent portions. Each of said plural nipping planes maybe flat. Furthermore, the inner face of the coupling element may be a polygonal shape.

Further, it is preferable that a peripheral face of the coupling protrusion is defined by plural ridges while each defined region is a plane inclined from its proximal portion to its vertex. A usual coupling protrusion formed on the coupling element head is conical. To the contrary, according to the present invention, the coupling protrusion formed on the coupling element head is formed in a frustum of polygonal cone. Because the coupling protrusion is formed in the form of the frustum of polygonal cone, when a pushing force is applied to a row of the coupling elements in a coupling state of the slide fastener or right/left stringers of the slide fastener are bent along the coupling line of the coupling elements or an external force such as a lateral force of pulling the coupling elements in the coupling state outward is applied, the ridge portions of a mating coupling head accommodated in an accommodating concave portion formed in a surface opposite to the coupling protrusion of the coupling element block the coupling element from rotating within the accommodating concave portion, so that disengagement of the coupling elements is prevented.

EMBODIMENTS OF INVENTION

Hereinafter, typical embodiments of the present invention will be described in detail with reference to the accompanying drawings.

Figure 1:
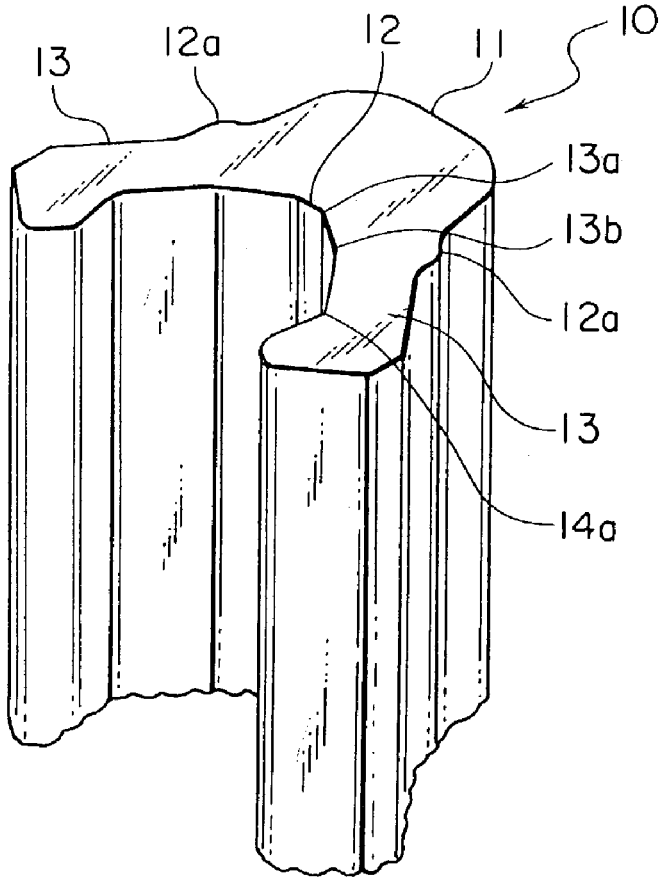
FIG. 1 is a perspective view showing partially a configuration of a typical embodiment of a metal wire rod for forming coupling elements of a slide fastener according to the present invention.
Figure 2:
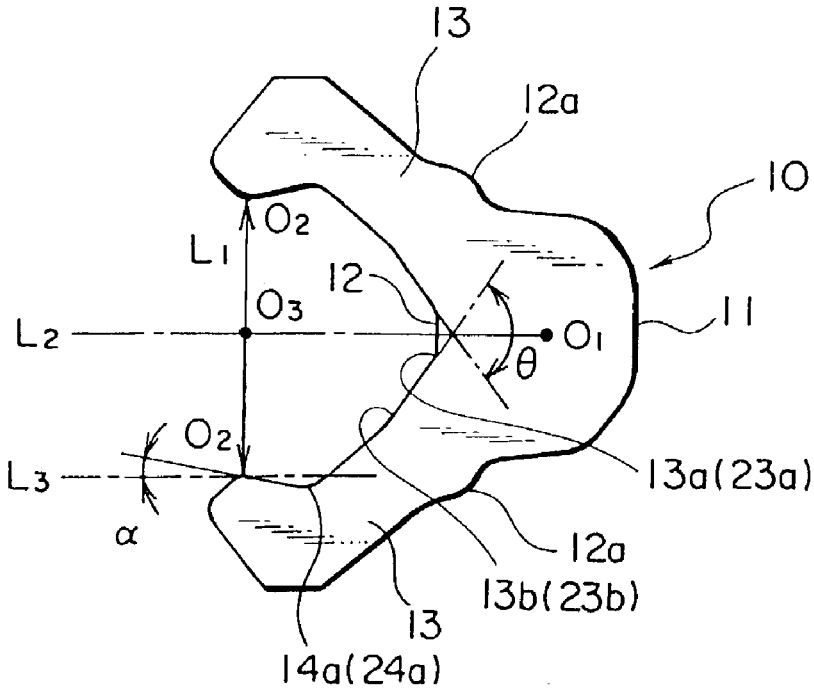
FIG. 2 is a plan view showing a section of the metal wire rod and an external shape of a coupling element obtained from the same wire rod.

FIG. 1 is a perspective view of part of the metal wire rod for forming a coupling element of a slide fastener, as taken from its leg side, showing the first embodiment of the present invention. FIG. 2 is a sectional view of the same wire rod as well as a plan view showing an external shape of a coupling element obtained by cutting the same wire rod.

FIGS. 1 and 2 show a metallic wire rod 10, which is a material for forming coupling elements. Usually, the wire rod 10 is not formed by extrusion or drawing, but instead it is formed by multi-stage rolling on a peripheral face of the wire rod having a circular section so as to be deformed into a wire having such a sectional shape as shown in FIG. 1. Like the conventional one, the metal wire rod 10 for forming coupling elements according to this embodiment comprises a head part 11 to be a coupling head 21 after cutting, a pair of right and left leg parts 13 extended from the head part 11 through a crotch part 12 such that they are opened outward, and pawl parts 14 projected inward from each of the leg parts such that they intersect the respective leg parts 13.

After the metal wire rod 11 having such a configuration is cut to a predetermined thickness, a coupling protrusion 21*a* is formed at a center of the coupling head 21 so that it serves as a coupling element 20. The coupling elements 20 are mounted along a coupling element mounting portion on each of opposing side edge portions of fastener tapes (not shown). As a result, a slide fastener chain is produced.

The components of the aforementioned metal wire rod 10 of this embodiment have five features as follows.

(1) An inner face of each of the right and left leg parts 13 opened from the crotch part 12 has plural bent portions 13*a*, 13*b* which are bent inward and a bent portion 14*a* of the pawl part 14, which is protruded from a front end portion of each of the legs 23 such that it is bent inward. The plural bent portions 13*a*, 13*b* and the bent portion 14*a* form multiple steps in the extending direction of the leg part 13.

(2) opposing inner faces of the pawl parts 14 projected inward from the front end portions of the pair of leg parts 13 are not parallel to each other but they are inclined so as to be closer to each other toward their front ends. That is, when a straight line $L_3$ is drawn through a front end $O_2$ of each of the right and left pawl parts 14 in parallel to a straight line $L_2$ connecting a center $O_1$ of a section of the head part 11 with a middle point $O_3$ of a straight line $L_1$ connecting the front ends $O_2$ of the right and left pawl parts 14 with each other, the pawl parts 14 are projected inward such that a bent point 14*a*, which is a border between the leg part 13 and a projection proximal end portion of the pawl part 14, is located outside the straight line $L_3$.

(3) The opening angle θ of the right and left leg parts 13 is set 75° to 85°, which is smaller than the conventional ones.

(4) A bulging portion 12*a*, which bulges outward gently in the shape of a hill, is formed on the outer surface of the crotch part 12 connecting the head part 11 with the right and left leg parts 13. That is, the thickness of the crotch part 12 is increased locally and outwardly.

(5) Although not shown, hardness of the central portion of the head part 11 is set lower than that of the leg part 13.

In the present invention, any one of these structures may be selected independently, but these may be combined appropriately.

The above-described structure (1) and the bent portions 13*a*, 13*b*, 14*a* described in (2) can be formed by a varied peripheral shape of a rolling roller (not shown) when the metal wire rod 10 is rolled. The structure of the pawl part 14 projecting so as to be bent inward of the leg part 13 as described in (2) can be obtained by rolling the inner faces of both the pawl parts 14 in parallel to each other in the same manner as was conventionally done and then bending the pawl parts 13 with respect to the leg parts 13. The structure described in (5) can be obtained by, for example, local quenching. Of course, it is permissible to provide the difference of hardness by another processing method such as rolling.

In the metal wire rod 10 for forming coupling elements of a slide fastener of this embodiment having the above-described characteristic structure, the plural bent faces 13*a*, 13*b*, which are bent inward, are formed successively from the crotch part 12 up to the front ends of the leg parts 13 by rolling process, based on the above-described structure (1). These bent portions exert positioning of the wire rod 11 while the wire rod 11 is being rolled. Accordingly, an accurate symmetrical configuration of the metal wire rod 10 can be obtained with respect to a plane extending in the longitudinal direction of the metal wire rod 10, which is obtained by connecting the middle point $O_3$ in the straight line $L_1$ connecting the front ends $O_2$, $O_2$ of the right and left pawl parts 14 with the center $O_1$ of the head part 11. Therefore, the coupling element 10, which is obtained by cutting the wire rod 10, is accurately symmetrical with respect to the straight line $L_2$ as shown in FIG. 2, so that when the coupling elements are mounted on a fastener tape, the mounting posture of each coupling element can be stabilized.

According to the structure in (2), the inner faces of the right and left pawl parts 14 projected inward such that they intersect the front ends of the leg parts are not so designed as to be in parallel to each other avoiding an interference with an end face of a rolling roller, which was done for a conventional Metal wire rod. Instead, according to the present invention, the inner faces of the right and left pawl parts 14 are provided so as to protrude toward each other with a smaller gap such that extensions thereof in the front end direction intersect each other. That is, each of the pawl parts 14 is bent such that the bent portion 14*a*, which is a border between the inner face of the leg part 13 and an inner face of the proximal end portion of the pawl part 14, exists outside a plane which is parallel to the plane obtained by connecting the middle point $O_3$ of the straight line connecting the front ends $O_2$, $O_2$ of the right and left pawl parts 14 with the center $O_1$ of the head part 11 and passes through the front end of the pawl part 14. The bending angle $\alpha$ is 10° or less, more preferably about 3 to 7°. Consequently, the gap between the inner faces of the pawl parts 14 opposing each other is not uniform, but the gap between the inner faces of the pawl parts 14 narrows gradually from the proximal end of the paw parts 14 to the front end thereof.

With such structure, when the coupling elements obtained by cutting the metal wire rod 10 are mounted on a fastener tape by caulking, the pawls bite into the fastener tape at a sharp angle with respect to each coupling element. As a result, even when a force pulling the coupling elements in a direction apart from the fastener tape, i.e., a lateral force, is applied, the coupling elements never escape from the fastener tape, thereby securing a stabilized mounting strength.

On the other hand, according to this embodiment, if the opening angle $\theta$ between the right and left leg parts 13 is set not as large as 92° like the conventional one, but set as small as 75° to 85° as explained in the constitution (3), the coupling element, which is obtained by cutting, becomes less likely to rotate on the fastener tape at the time of caulking. Consequently, the mounting posture of the coupling elements is stabilized, so that not only the coupling elements can be easily mounted on the fastener tape with a good balance but also a biting angle required for the pawl 24 becomes easier to obtain, thereby intensifying the mounting strength further.

According to this embodiment, such as the structure in (4), the bulging portion 12*a* is formed by bulging the outer surface of the crotch part 12 which connects the head part 11 with each of the right/left leg parts 13 in the shape of a gentle hill directed outward. In a case where the outer surface of a joint portion between the head part and the leg part is simply a flat surface like that of an ordinary coupling element, the leg part of the coupling element obtained from the wire rod is deformed and bent inward when the leg part is caulked with a caulking punch. As a result, the outer surface is stretched at the joint portion, and consequently, the outer surface of the joint portion becomes dented inward so that the joint portion becomes thinner. Therefore, the strength of the joint portion falls, so that the coupling element becomes likely to be buckled at the joint portion. Thus, the mounting strength to the fastener tape is reduced largely.

To the contrary, according to this embodiment, the bulging portion 12*a*, i.e. a thicker portion, is formed on the outer surface of the crotch part 12 at the joint portion between the head part 11 and the leg part 13 of the metal wire rod 10. Therefore, when the leg 23 of the coupling element 20 is caulked at the time of being mounted on a fastener tape, the bulging portion 12*a* formed on the outside face of the crotch 22 is stretched. Consequently, even if the thickness is reduced, the reduction of the thickness is supplemented by that thicker portion, so that the reduction of the strength at the joint portion never occurs thereby securing a required mounting strength to the fastener tape.

If the hardness of at least a coupling protrusion forming region of the head part is set smaller than that of the leg part as in the structure (5), the hardness of the head 21 of the coupling element 20 obtained afterwards is smaller than that of the legs 23. When the legs 23 have normal hardness, i.e., stiffness, the head 21 is softer and easier to deform. Thus, while the stiffness of the leg parts is secured, the coupling protrusion 21*a* with a required height can be formed on the head 21 easily. When such a predetermined height of the protrusion 21*a* is obtained, necessary engagement strength between the coupling elements 20 can be improved. Further, because the head 21 is soft, load applied to protrusion forming punch and die (not shown) can be reduced when the coupling protrusions 21*a* are formed. Thus, even if ordinary punch and die are employed, durability thereof can be improved remarkably.

Figure 3:
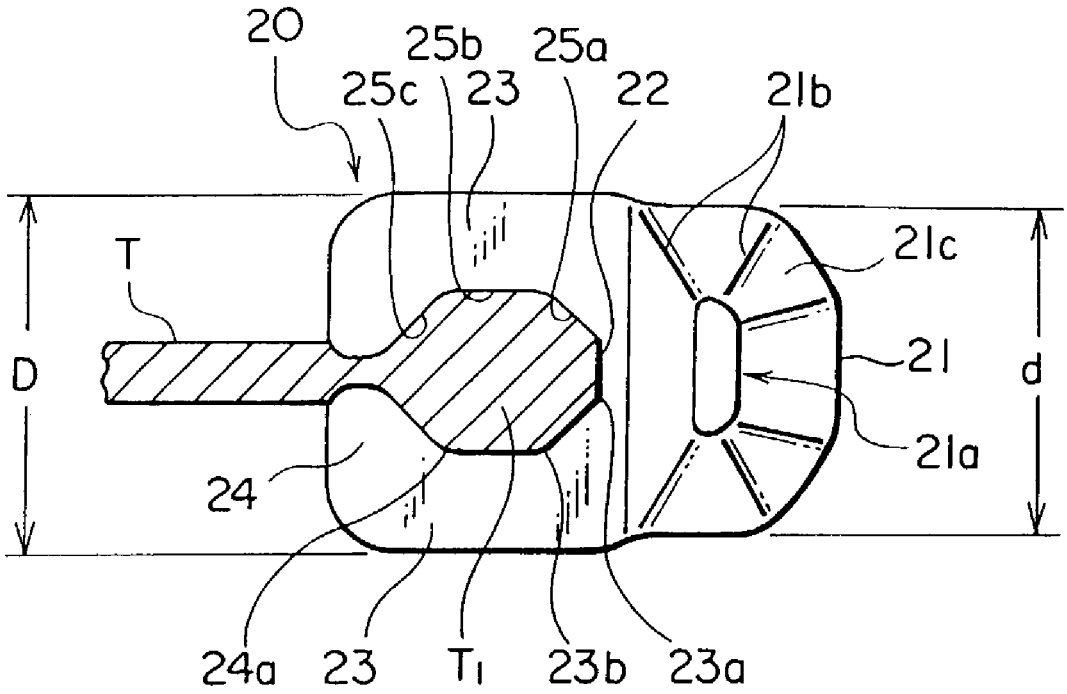
FIG. 3 is a partial sectional view showing a mounting state of the coupling element of the present invention on a fastener tape, which is obtained from the metal wire rod.
Figure 4:
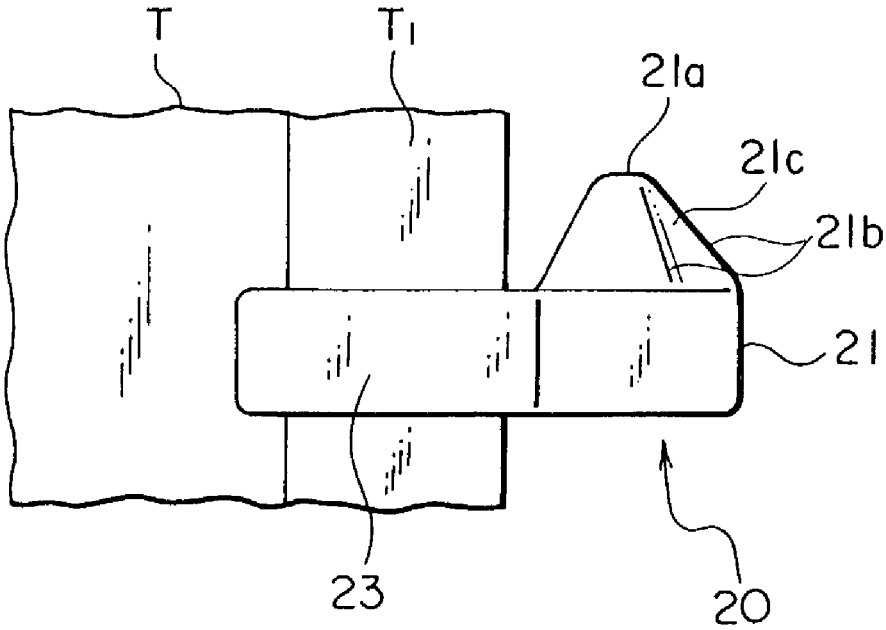
FIG. 4 is a plan view of FIG. 3.

FIGS. 3 and 4 show the structure when the coupling elements obtained from the metal wire rod 10 for forming coupling elements of the above-described embodiment are mounted on a fastener tape.

The coupling elements 20 of this embodiment are manufactured by cutting (slicing) the metal wire rod 10, which has a section shown in FIG. 2, to predetermined thickness successively and then forming coupling protrusions 21*a*, which protrude from one side of the coupling element, in the centers of the engaging heads 21 with head forming punch and die (not shown).

Each of the coupling elements 20 obtained from the metal wire rod 10 of this embodiment has a pair of legs 23, 23 extending from the head 21 through the crotch 22. Bent portions 23*a*, 23*b*, which are bent inward, are formed successively in the extending direction of the leg 23 on an inner face of the leg 23 from the crotch 22 toward the front end portion of the leg 23 so as to be bent in two stages. Further, a pawl 24 is protruded so as to be bent inward from the front end portion of the leg 23. A bent portion 24*a*, which is a boundary surface for connecting an inner face of the proximal end portion of the pawl 24 projected from the leg 23 with an inner face of the leg 23, is located outside the straight line $L_3$ which is parallel to the straight line (hereinafter referred to as a center line) $L_2$ connecting the middle point $O_3$ of a straight line $L_1$ between the front ends $O_2$, $O_2$ of the right and left pawls 24 with the center $O_1$ of the head and which passes through the front ends $O_2$, $O_2$ of the pawls 24.

When the right/left legs 23, 23 of the coupling element 20 having such a configuration are mounted on a core string portion T1 extending along an coupling elements mounting portion of a side edge portion of a fastener tape T by caulking with a caulking hammer (not shown), the legs 23 of the coupling element 20 are bent uniformly along each of the bent portions 23*a*, 23*b*. Consequently, as shown in FIG. 3, the pawls 24 bite into the fastener tape T strongly and the inner face of the coupling element 20 extending from the crotch 22 toward the front end of the leg 23 including the pawl 24 forms a polygonal shape. Therefore the entire periphery of the core portion T1 can be pressed with a uniform and strong pressing force by the respective nipping planes 25*a*, 25*b* between the bent portions 23*a*, 23*b* and 24*a* and an internal nipping plane 25*c* of the pawl 24. As a result, not only the mounting strength by the pawl 24 biting into the fastener tape T according to the above-described structure is increased, but also the mounting strength by the aforementioned flat surfaces is increased. Further, friction resistance between the inner face of the leg 23 of the polygonal shape and the core portion T1 is also increased, so that the coupling element 20 is prevented from starting with respect to the core portion T1, thereby maintaining a stable mounting position of the coupling element 20.

On the other hand, as described above, the head part 11 whose hardness is set lower than that of the leg parts 13 when the metal wire rod 10 is produced keeps stiffness necessary for coupling because the hardness at and around the protrusion 21*a* is intensified when the head 21 and the protrusion 21*a* are formed with a protrusion forming punch and die (not shown) after the cutting.

Figure 7:
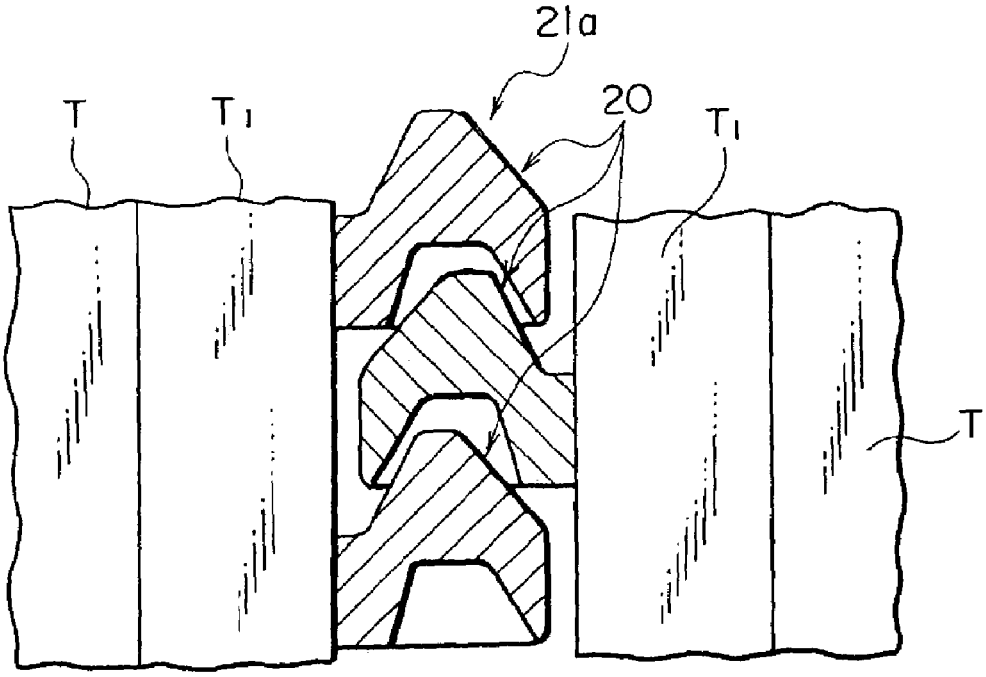
FIG. 7 is a longitudinal sectional view showing partially a coupling state of the coupling elements along the fastener tape.
Figure 8:
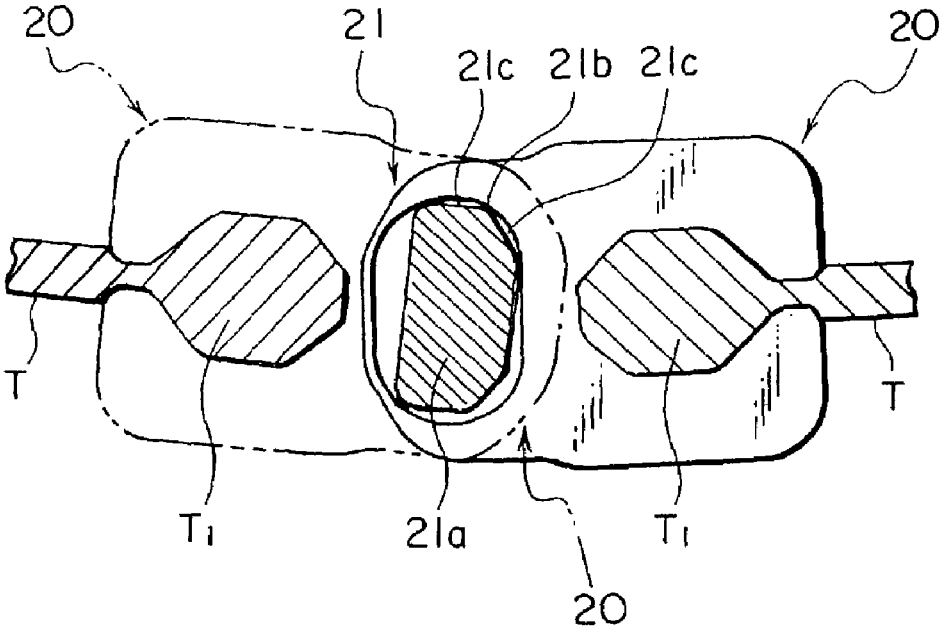
FIG. 8 is an explanatory view for explaining the action of coupling protrusions when a rotation force with respect to the coupling center is applied to the fastener tape along the coupling element rows in the coupling state.

According to this embodiment, as shown in FIGS. 3 and 4, the aforementioned coupling protrusion 21*a* is formed in the form of a substantially polygonal pyramid such that multi-stage inclined surfaces 21*c* are formed on the peripheral face of the coupling protrusion 21*a* with plural ridges 21*b*. Therefore, even if an external force, which rotates right and left fastener tapes T relatively as shown in FIG. 8 with respect to the coupling center of the coupling element 21, is applied when the coupling elements 20 engage each other as shown in FIG. 7, the coupling protrusion 21*a* becomes unlikely to rotate within its accommodating concave portion due to the ridges 21*b* of the polygonal section. Thus, even when a pushing force is applied to between the coupling elements 20 of the slide fastener in the coupling state, or any external force is applied such that the right and left stringers of the slide fastener are bent along the coupling line of the coupling element rows of the left and right stringers of the slide fastener or such that the coupling elements in the coupling state are pulled laterally and outwardly, the coupling of the coupling elements is never released.

Further in the coupling element 20 of this embodiment, as shown in FIG. 3, there is a difference between the width d of the head 21 and the width D between outside faces of the right and left legs 23. This is because the manufacturing cost of the coupling elements 20 can be reduced and because the legs 23 are demanded to have a higher strength than the head 21 as a component of the coupling element 20, thereby reducing the amount of the material used for the head 21. Therefore, the width d of the head 21 is set smaller than the width D between the outer faces of the pair of legs 23. Even when the width d of the head 21 is set smaller than the width D of the pair of legs 23, the mounting strength of the coupling element 20 to the fastener tape T and the coupling strength between the coupling elements 20 can be secured as described above, thereby leading to reduction of the material cost. Consequently, the manufacturing cost of the coupling elements can be reduced.

Only when the width d of the head 21 is set smaller than the width D of the legs 23, the appearance becomes poor and disharmony occurs. However, the surface of the head 21 looks larger than it is because the configuration of the coupling protrusion 21*a* of the coupling element 20 is in the form of a polygonal pyramid as described above. Consequently, the appearance is kept excellent and it does not look like the amount of the material of the head 21 is reduced, but the head looks even larger to the contrary.

Figure 5:
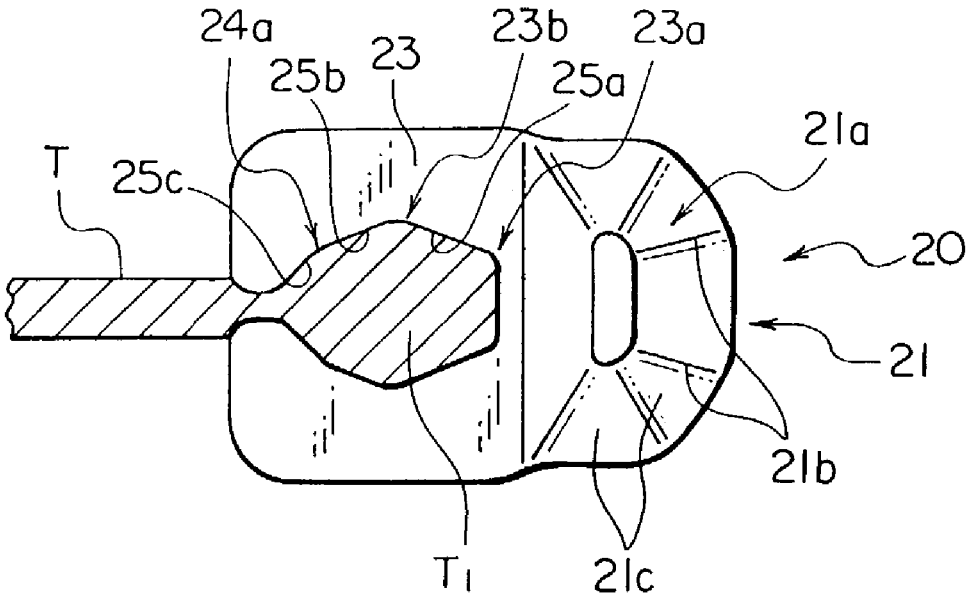
FIG. 5 is a partial sectional view showing a mounting state of a coupling element on a fastener tape according to a modified example of the coupling element of the present invention.
Figure 6:
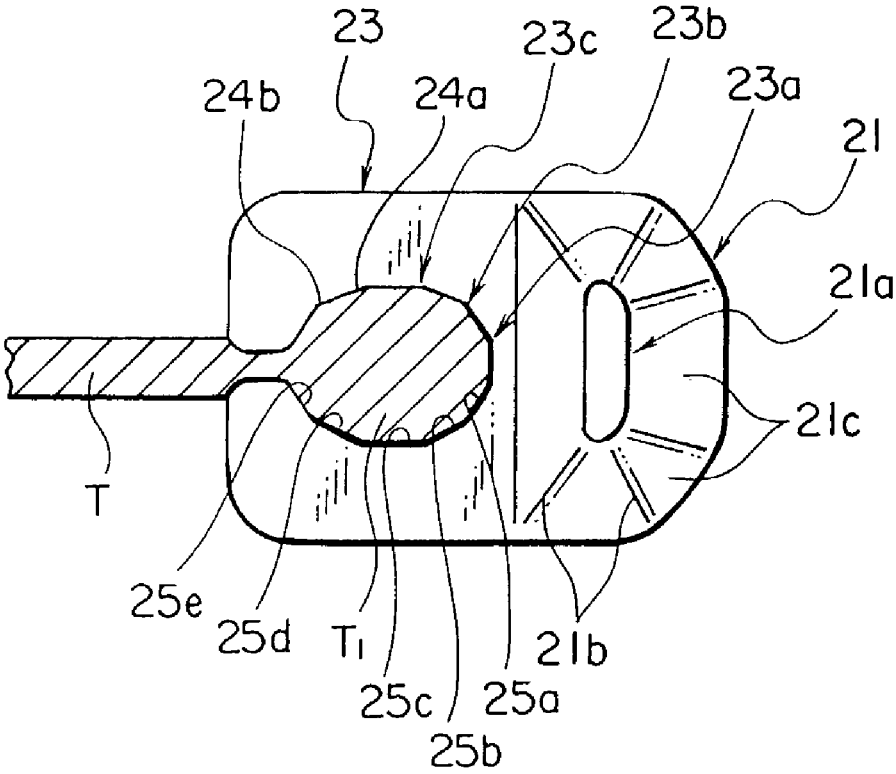
FIG. 6 is a partial sectional view showing a mounting state of a coupling element on a fastener tape according to another modified example.

FIGS. 5 and 6 show modified examples of the present invention. According to the modified example shown in FIG. 5, the bent portion 23*a* is formed on the inner face of each of the right and left legs 23 as a first stage, the bent portion 23*b* near the pawl 23 is placed at the protrusion proximal end of the pawl 24, and bent portions 24*a*, 24*b* as two stages are formed on the pawl 24. In the modified example shown in FIG 6, three stages of bent portions 23*a* to 23*c* are formed on the inner face each of the legs 23 while two stages of the bent portions 24*a*, 24*b* are formed on the inner face of the pawl 24, so that nipping planes 25*a* to 25*e* are formed adjacent to each other via the bent portions 23*a* to 23*c*, 24*a*, 24*b*. Therefore, in the modified example shown in FIG. 5, a polygon formed by the crotch 22, the legs 23 and the pawls 24 when the coupling elements are mounted on the fastener tape T is different in shape from the above-described embodiment shown in FIG. 3, but it is the same in terms of heptagon. The modified example shown in FIG. 6 is hendecagon.

The above statement describes only the typical embodiments of the present invention and needless to say, the present invention may be modified in various ways within the technical matters described in claims for a patent.

What is claimed:

1. A slide fastener coupling element comprising:

a head having a coupling protrusion;

a pair of right and left legs, each of which extending from the head through a crotch, the crotch consisting of a single flat face; and a pair of pawls projected inward from front ends of the respective legs, wherein the pair of legs have plural inner faces between the flat face of the crotch and the pair of pawls, respectively, and the inner faces being progressively and entirely bent inward from the crotch so as to form plurally-stepped bent portions from the crotch up to the respective pawls.

2. The slide fastener coupling element according to claim 1, wherein each of the inner faces has plural nipping planes which are adjacent to each other via said plurally-stepped bent portions.

3. The slide fastener coupling element according to claim 2, wherein each of said plural nipping planes is flat.

4. The slide fastener coupling element according to claim 1, wherein each of the inner faces is a polygonal shape.

5. The slide fastener coupling element according to claim 1, wherein a width dimension of the head is set smaller than a width dimension between outer side faces of the pair of legs.

6. The slide fastener coupling element according to claim 1 or 5, wherein a peripheral face of the coupling protrusion is defined by plural ridges while each defined region is a flat plane inclined from a proximal portion to a vertex thereof.

* * * * *